US010833441B2

(12) United States Patent
Hsu

(10) Patent No.: US 10,833,441 B2
(45) Date of Patent: Nov. 10, 2020

(54) ELECTRICAL CONTACT

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Shuo-Hsiu Hsu, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/699,321

(22) Filed: Nov. 29, 2019

(65) Prior Publication Data

US 2020/0176912 A1 Jun. 4, 2020

(30) Foreign Application Priority Data

Nov. 30, 2018 (CN) ..... 2018 1 1453463

(51) Int. Cl.
*H01R 12/00* (2006.01)
*H01R 13/24* (2006.01)
(Continued)

(52) U.S. Cl.
CPC ..... *H01R 13/2457* (2013.01); *H01R 4/02* (2013.01); *H01R 13/428* (2013.01)

(58) Field of Classification Search
CPC .... H01R 13/2457; H01R 13/428; H01R 4/02; H01R 13/41; H01R 13/2442;
(Continued)

(56) References Cited

U.S. PATENT DOCUMENTS 6,210,176 B1 * 4/2001 Hsiao ..... H05K 7/1069 439/71
7,052,284 B2 * 5/2006 Liao ..... H01R 13/2435 439/66

(Continued)

FOREIGN PATENT DOCUMENTS

CN 201285852 Y 8/2009
CN 208045769 U 11/2018

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical contact includes a main body, a supporting arm extending upwardly from an upper edge thereof, and a spring arm extending curvedly and upwardly from a lower edge thereof with a contacting region at a free end. The spring arm will contact the supporting arm when the spring arm is downwardly pressed by the CPU. A solder part is sidewardly connected to a downward extension formed on a lower portion of the main body and located beside the spring arm, and includes a vertical section extending from the side edge of the downward extension, a horizontal solder pad extending from a lower edge of the vertical direction wherein a curved joint is formed between the downward extension and the vertical section for easy adjusting the angle formed between the downward extension and the vertical section, thus being adapted to fit different CPUs and PCBs.

20 Claims, 4 Drawing Sheets

(51) Int. Cl.
*H01R 13/428* (2006.01)
*H01R 4/02* (2006.01)

(58) Field of Classification Search
CPC ..... H01R 13/2492; H01R 13/2435; H01R 13/03; H01R 13/2414; H01R 12/716; H01R 33/74
USPC ..... 439/873, 626, 66, 83
See application file for complete search history.

(56) References Cited

U.S. PATENT DOCUMENTS 7,390,195 B2 * 6/2008 Liao ..... H01R 13/2435 439/66
7,429,200 B2 * 9/2008 Lee ..... H01R 13/2442 439/862
7,559,811 B1 * 7/2009 Polnyi ..... H01R 4/4809 439/591
7,625,217 B1 * 12/2009 Liao ..... H01R 12/714 439/66
7,878,818 B2 * 2/2011 Cheng ..... H01R 13/2435 439/66
7,972,144 B2 * 7/2011 Chang ..... H01R 4/02 439/66
7,988,501 B2 * 8/2011 Chang ..... H05K 7/1069 439/751
8,235,734 B2 * 8/2012 Ju ..... H01R 12/57 439/83
8,366,453 B2 * 2/2013 Chang ..... H01R 12/58 439/70
8,523,615 B2 * 9/2013 Luo ..... H01R 12/7082 439/660
8,708,716 B1 * 4/2014 Ho ..... H01R 43/02 439/83
9,437,948 B2 * 9/2016 Ju ..... H01R 12/7076
10,199,756 B2 * 2/2019 Ju ..... H01R 12/7076
10,468,795 B2 * 11/2019 Cheng ..... H01R 13/41
10,547,136 B2 * 1/2020 Ho ..... H01R 12/55
10,601,159 B2 * 3/2020 Wu ..... H01R 12/91
10,651,584 B2 * 5/2020 Hsu ..... H01R 13/428
2004/0266227 A1 * 12/2004 Ma ..... H01R 12/52 439/71
2005/0026478 A1 * 2/2005 Chiang ..... H05K 3/3426 439/83
2005/0054218 A1 * 3/2005 Liao ..... H01R 12/52 439/66
2009/0047817 A1 * 2/2009 Liu ..... H01R 13/2492 439/296
2009/0263985 A1 * 10/2009 Liu ..... H01R 13/2457 439/66
2009/0269950 A1 * 10/2009 Liao ..... H01R 13/2492 439/66
2010/0015861 A1 * 1/2010 Zhang ..... H05K 7/1007 439/733.1
2010/0055944 A1 * 3/2010 Chang ..... H01R 13/2435 439/78
2010/0055997 A1 * 3/2010 Szu ..... H01R 13/193 439/861
2011/0014816 A1 * 1/2011 Fan ..... H01R 12/57 439/626
2011/0032681 A1 * 2/2011 Chang ..... H05K 3/308 361/747
2011/0111607 A1 * 5/2011 Chang ..... H01R 12/7076 439/70
2011/0151723 A1 * 6/2011 Liao ..... H01R 12/57 439/660
2012/0028502 A1 * 2/2012 Yeh ..... H05K 7/1069 439/626
2012/0129406 A1 * 5/2012 Hsu ..... H01R 12/716 439/701
2013/0237066 A1 * 9/2013 Yeh ..... H05K 7/10 439/65
2014/0024231 A1 * 1/2014 An ..... H01R 13/2457 439/68
2014/0030925 A1 * 1/2014 Terhune, IV ..... H01R 12/714 439/626
2018/0212347 A1 * 7/2018 Chang ..... H01R 4/02
2018/0375243 A1 * 12/2018 Hsu ..... H01R 12/712
2019/0052021 A1 * 2/2019 Hsu ..... H01R 43/20
2019/0334272 A1 * 10/2019 Hsu ..... H01R 13/646
2020/0176912 A1 * 6/2020 Hsu ..... H01R 13/2442

FOREIGN PATENT DOCUMENTS

CN 109103646 A 12/2018
CN 208336576 U 1/2019

* cited by examiner

ELECTRICAL CONTACT

1. FIELD OF THE DISCLOSURE

The invention is related to an electrical contact for use with an electrical connector, and particularly to an electrical contact with a solder part extending laterally from a side edge of a main body thereof so as to easily adjust the corresponding position of the solder pad disregarding how such a solder pad is offset from the corresponding contacting region of the contacting arm in the horizontal direction in a top view.

2. DESCRIPTION OF RELATED ARTS

China Utility Patent No. CN201285852 discloses an electrical contact for use with an electrical connector accommodating a CPU (Central Processing Unit). The contact includes a main body with barbed structures on two lateral sides, a solder part extending from a bottom edge of the main body, and a resilient contacting arm extending from a secondary body which is laterally connected to the main body. Notably, different CPUs cooperating with different PCBs (printed circuit boards) may result in different transverse offset relation between the contacting region of the contacting arm and the solder pad of the contact in a top view. The basic structure disclosed in the aforementioned CN201285852 essentially provides less flexibility for different offset arrangements between the contacting region and the solder pad of the contact.

It is desired to provide the contact of the connector with a relatively high flexibility for rearranging the horizontal offset relation between the contacting region and the solder pad so as to meet different CPUs and different PCBs.

SUMMARY OF THE DISCLOSURE

To achieve the above desired purpose, an electrical contact for use with an electrical connector made from sheet metal, includes a planar main body, a supporting arm extending upwardly from an upper edge thereof, and a spring arm extending curvedly and upwardly from a lower edge thereof with a contacting region at a free end region. The spring arm will contact the supporting arm when the spring arm is downwardly pressed by the CPU. A connecting part extends from an upper portion of the main body for connecting to a carrier strip, and is located beside the supporting arm. A solder part is sidewardly connected to a downward extension on a lower portion of the main body located beside the spring arm, and includes a vertical section extending from the side edge of the downward extension, a horizontal solder pad extending from a lower edge of the vertical direction wherein a curved connection section is formed between the downward extension and the vertical section for easy adjusting the angle formed between the downward extension and the vertical section in a top view, thus being adapted to fit different CPUs and PCBs.

DETAILED DESCRIPTION OF THE PREFERRED EMBODIMENT

Figure 1:
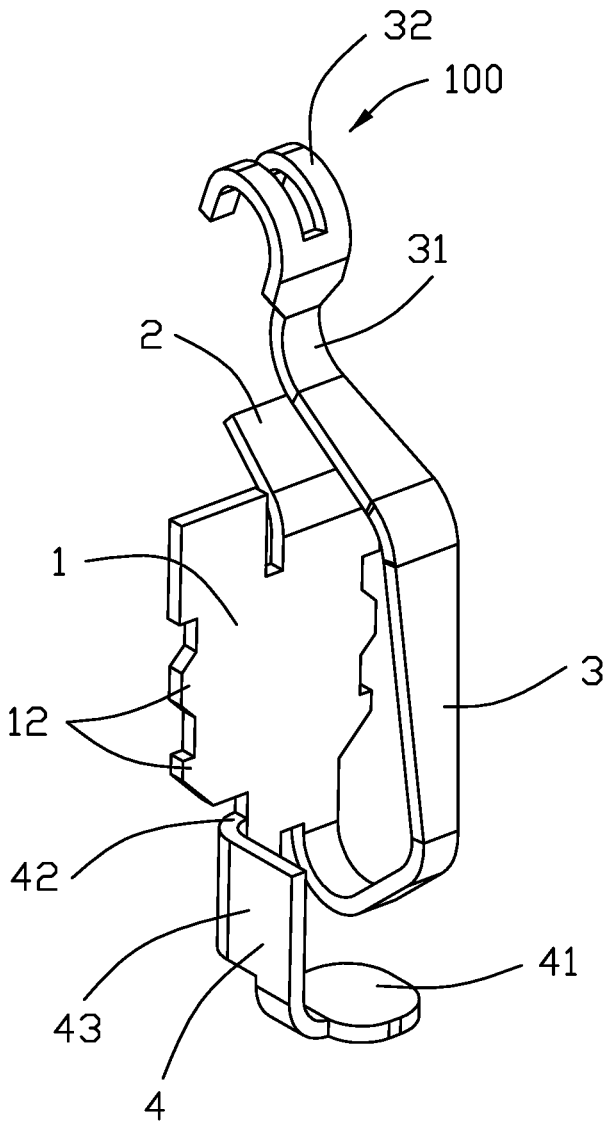
FIG. 1 is a perspective view of an electrical contact of the invention.
Figure 2:
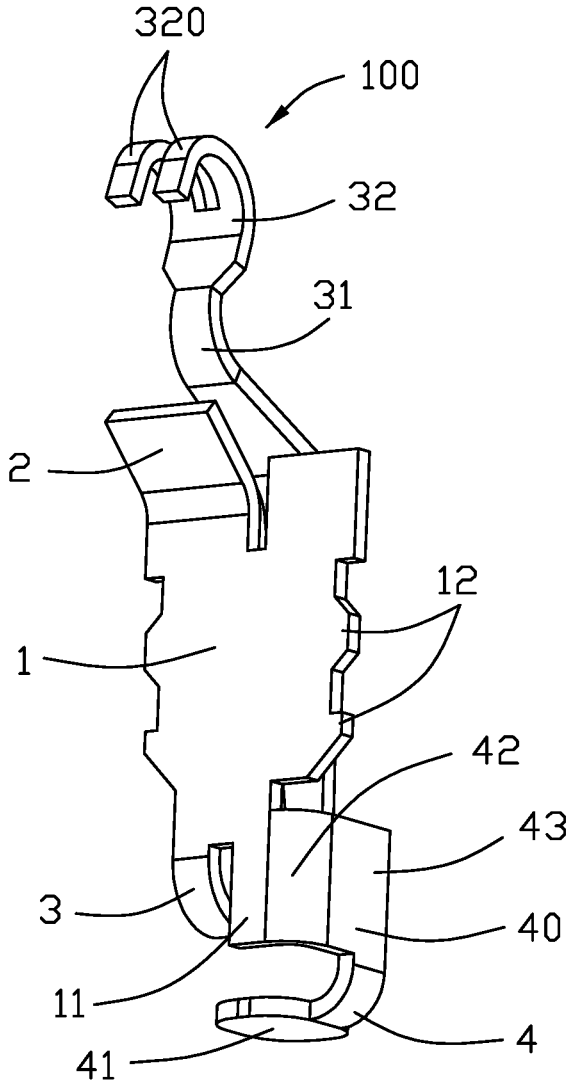
FIG. 2 is another perspective view of the electrical contact of FIG. 1.
Figure 3:
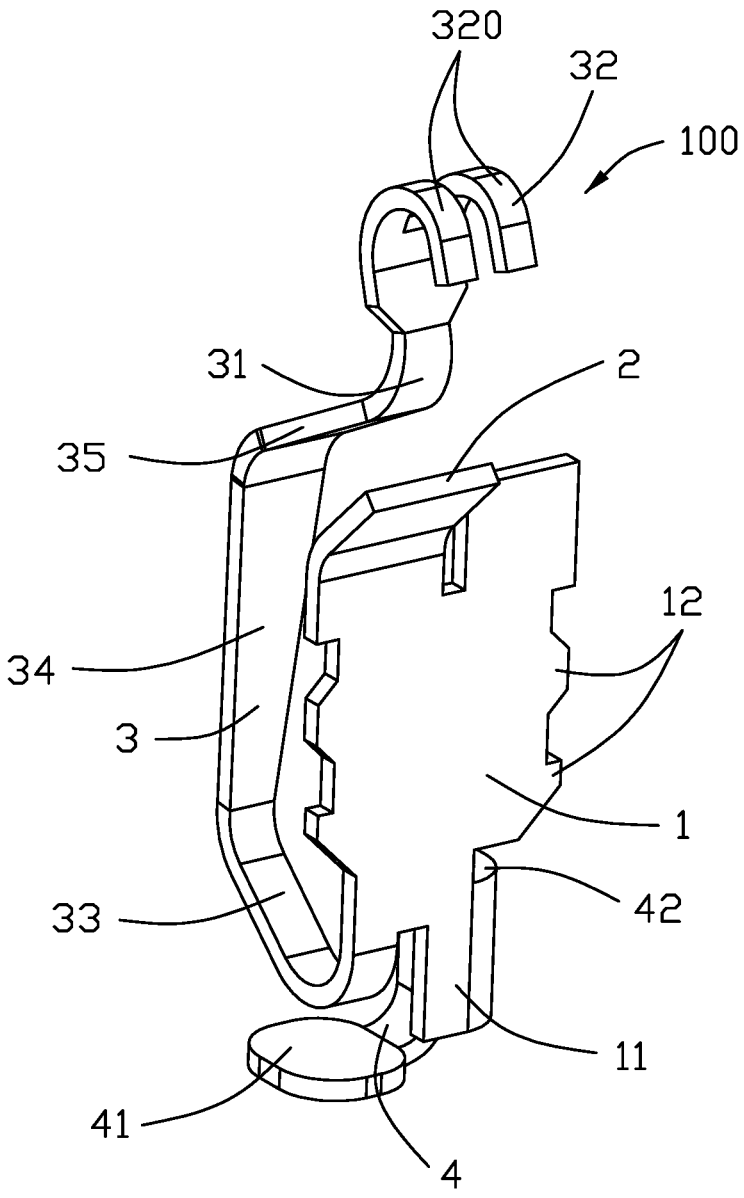
FIG. 3 is another perspective view of the electrical contact of FIG. 1 when the spring arm is in a free/relaxed manner.
Figure 4:
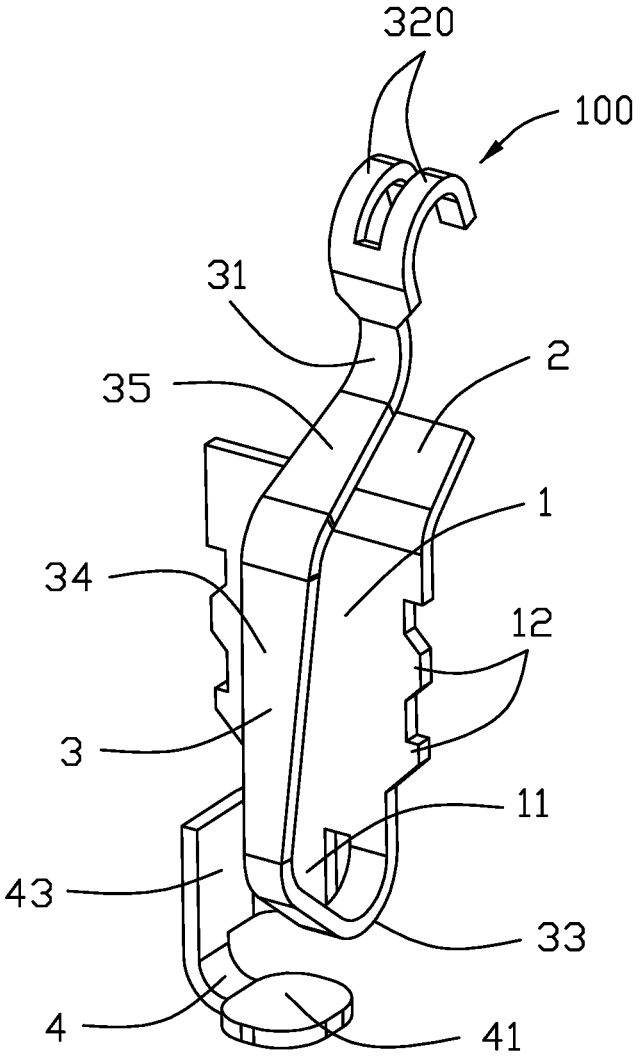
FIG. 4 is another perspective view of the electrical contact of FIG. 1.

Reference will now be made in detail to the embodiment of the present disclosure. Referring to FIGS. 1-4, an electrical contact 100 for use within an electrical connector housing (not shown) accommodating a CPU (not shown), is stamped from sheet metal and includes a main body 1, a supporting arm 2 upwardly extending from an upper edge of the main body 1, a spring/contacting arm 3 curved and upwardly extending from a lower edge of the main body 1, and a solder part 4 extending from a lower end of the main body 1. A pair of barb structures 12 are formed on two lateral sides of the main body 1 for retaining the contact 100 in the connector housing. The contacting arm 3 includes an oblique section 31 confronting the supporting arm 2, and a contacting region 32 upwardly extending from the oblique section 31. When the contacting region 32 is pressed downwardly by the CPU, the contacting arm 3 is downwardly deflected to have the oblique section 31 contact the supporting arm 32 to form a so-called self-contacting thereof. The oblique section 31 and the supporting arm 32 commonly form a self-contacting region 10 on which the relative precious gold coating is applied. A connecting part (not labeled) is formed on the upper portion of the main body 1 beside the supporting arm 2, to which a carrier strip for loading the contact into the connector housing is linked.

Referring to FIGS. 1-4, the solder part 4 includes a linking portion 40 having a vertical section 43 laterally connected, via a curved joint 42, to the vertical downward extension 11 formed at a lower end of the main body 1, and a horizontal solder pad 41 extending from the vertical section 43 and located under the contacting arm 3. A solder ball (not shown) is adapted to be attached upon the solder pad 41. Notably, the angle between the vertical downward extension 11 and the vertical section 43 can be different from the right angle in an adjustable manner so as to harmonize different CPUs and PCBs with each other. In this embodiment, the main body 1, the vertical section 43 and the solder pad 41 are perpendicular to one another.

Referring to FIGS. 1-4, both the contacting arm 3 and the supporting arm 2 are located on one lateral side of the main body 1 while both the solder part 4 and the connecting part (not labeled) are located on the other lateral side of the main body 1.

Referring to FIGS. 1-4, the contacting arm 3 includes a first bending section 33 extending from the main body 1, an upstanding section 34 extending upwardly from the first bending section 33, and a second bending section 35 extending from the upstanding section 34 toward the supporting arm 2 wherein the oblique section 31 extends from the second bending section 35. The contacting region 32 includes two spaced straps 320.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical contact for use within an electrical connector, comprising:

a main body;

a resilient contacting arm extending curvedly and upwardly from a lower edge of the main body;

a supporting arm extending upwardly from an upper edge of the main body with a contacting region at a free end;

the contacting arm being adapted to contact the supporting arm when the contacting arm is downwardly pressed by a CPU (Central Processing Unit) so as to form therebetween an additional transmission path;

a vertical downward extension formed on a lower end of the main body beside the contacting arm; and a solder part including a vertical section angled with and laterally connected to the downward extension via a curved joint, and a horizontal solder pad extending from a lower edge of the vertical section; wherein in a top view taken along a vertical direction, relative horizontal positions between the contacting region and the solder pad can be varied by altering the curved joint to adjust the angle between the vertical section of the solder part and the downward extension of the main body.

2. The electrical contact as claimed in claim 1, wherein both the contacting arm and the supporting arm located on a same lateral side of the main body.

3. The electrical contact as claimed in claim 2, wherein said downward extension is formed on the other lateral side of the main body.

4. The electrical contact as claimed in claim 3, wherein a connecting part for connecting to a contact carrier strip to load the contact into the connector, is located on the other lateral side of the main body.

5. The electrical contact as claimed in claim 4, wherein said connecting part is located beside the supporting arm.

6. The electrical contact as claimed in claim 1, wherein the main body includes a pair of barbed structures on two lateral side edges.

7. The electrical contact as claimed in claim 1, wherein the supporting arm extends away from the contacting arm.

8. The electrical contact as claimed in claim 1, wherein the contacting arm includes an oblique section adapted to abut against the supporting arm, and a contacting region extending from the oblique section.

9. The electrical contact as claimed in claim 1, wherein said main body lies in a flat plane.

10. The electrical contact as claimed in claim 1, wherein the main body, the vertical section and the downward extension are perpendicular to one another.

11. An electrical contact for use within an electrical connector, comprising:

a main body;

a resilient contacting arm extending curvedly and upwardly from a portion of the main body;

a supporting arm extending upwardly from another portion of the main body with a contacting region at a free end;

the contacting arm being adapted to contact the supporting arm when the contacting arm is downwardly pressed by a CPU (Central Processing Unit) so as to form therebetween an additional transmission path;

a vertical downward extension formed on a lower end of the main body in a coplanar manner and located beside the contacting arm; and a solder part including a vertical section angled with and laterally connected to the downward extension via a curved joint, and a horizontal solder pad extending from a lower edge of the vertical section; wherein in a top view taken along a vertical direction, relative horizontal positions between the contacting region and the solder pad can be varied by altering the curved joint to adjust the angle between the vertical section of the solder part and the downward extension of the main body.

12. The electrical contact as claimed in claim 11, wherein both the contacting arm and the supporting arm located on a same lateral side of the main body.

13. The electrical contact as claimed in claim 12, wherein said downward extension is formed on the other lateral side of the main body.

14. The electrical contact as claimed in claim 13, wherein a connecting part for connecting to a contact carrier strip to load the contact into the connector, is located on the other lateral side of the main body.

15. The electrical contact as claimed in claim 14, wherein said connecting part is located beside the supporting arm.

16. The electrical contact as claimed in claim 11, wherein the main body includes a pair of barbed structures on two lateral side edges.

17. The electrical contact as claimed in claim 11, wherein the supporting arm extends away from the contacting arm.

18. The electrical contact as claimed in claim 11, wherein the contacting arm includes an oblique section adapted to abut against the supporting arm, and a contacting region extending from the oblique section.

19. The electrical contact as claimed in claim 1, wherein said main body lies in a flat plane.

20. The electrical contact as claimed in claim 11, wherein the main body, the vertical section and the downward extension are perpendicular to one another.

* * * * *